US012421814B2

(12) United States Patent
Brodie et al.

(10) Patent No.: US 12,421,814 B2
(45) Date of Patent: Sep. 23, 2025

(54) STABBING GUIDE DEVICE FOR A STEEL TUBE FOR USE IN A TUBULAR HYDROCARBON COLUMN

(71) Applicant: VALLOUREC OIL AND GAS FRANCE, Aulnoye-Aymeries (FR)

(72) Inventors: Alastair Brodie, Meudon (FR); Maxime Vannetzel, Meudon (FR)

(73) Assignee: VALLOUREC OIL AND GAS FRANCE, Aulnoye-Aymeries (FR)

( * ) Notice: Subject to any disclaimer, the term of this patent is extended or adjusted under 35 U.S.C. 154(b) by 0 days.

(21) Appl. No.: 18/721,892

(22) PCT Filed: Dec. 26, 2022

(86) PCT No.: PCT/EP2022/087844
§ 371 (c)(1),
(2) Date: Jun. 20, 2024

(87) PCT Pub. No.: WO2023/131563
PCT Pub. Date: Jul. 13, 2023

(65) Prior Publication Data

US 2025/0059836 A1 Feb. 20, 2025

(30) Foreign Application Priority Data

Jan. 4, 2022 (EP) ..... 22150253

(51) Int. Cl.
*E21B 19/24* (2006.01)
*E21B 19/16* (2006.01)

(52) U.S. Cl.
CPC ..... *E21B 19/24* (2013.01); *E21B 19/16* (2013.01)

(58) Field of Classification Search
CPC ..... E21B 19/24; E21B 19/16
See application file for complete search history.

(56) References Cited

U.S. PATENT DOCUMENTS 4,697,830 A 10/1987 Wood et al.
7,832,487 B2 11/2010 Jensen et al.
(Continued)

FOREIGN PATENT DOCUMENTS

CN 101876237 A 11/2010
EP 3 529 574 B1 8/2020
EP 3 819 459 A1 5/2021

OTHER PUBLICATIONS

International Search Report issued Feb. 20, 2023 in PCT/EP2022/087844, filed Dec. 26, 2022, 4 pages.

*Primary Examiner* — Taras P Bemko
(74) *Attorney, Agent, or Firm* — Oblon, McClelland, Maier & Neustadt, L.L.P.

(57) ABSTRACT

A stabbing guide device is for a steel tube to be secured on a portion of the tube used in a tubular column for oil and gas, energy, or storage applications. The device includes a substantially cylindrical body extending along a rotational axis to surround the portion of the first steel tube, the body forming an open ring so that a circumferential gap subsists between two free ends of the body, and a locking door secured to the body at one of the two free ends and movable compared to the body between a locked position in which the locking door rotates towards the body and surrounds the first tube, an intermediate position in which the locking door is slid along the rotational axis towards a lower end of the body, and an unlocked position in which the locking door is rotated radially away from the body.

15 Claims, 7 Drawing Sheets

(56) References Cited

U.S. PATENT DOCUMENTS

| | | | | |
|---|---|---|---|---|
| 2006/0207768 | A1 | 9/2006 | Angman et al. | |
| 2009/0242192 | A1* | 10/2009 | Jensen | E21B 19/24 166/380 |
| 2010/0200241 | A1* | 8/2010 | Ward | E21B 41/0014 166/341 |
| 2015/0226022 | A1* | 8/2015 | Angelle | E21B 19/10 166/85.5 |
| 2019/0242201 | A1 | 8/2019 | Roussie et al. | |
| 2022/0349263 | A1 | 11/2022 | Brodie et al. | |

* cited by examiner

STABBING GUIDE DEVICE FOR A STEEL TUBE FOR USE IN A TUBULAR HYDROCARBON COLUMN

BACKGROUND

The present invention relates to the field of devices for metal tubes intended for use in a tubular column for oil & gas, energy or storage application such as operating hydrocarbon wells, geothermal or carbon capture.

The present invention particularly relates to a stabbing guide device for mounting a male threaded portion of a second tube into a female threaded portion of a first tube.

The present invention also relates to a metal tube equipped with such a stabbing guide device.

A tubular hydrocarbon column or working string generally consists of a plurality of tubes attached together. More specifically, a tubular hydrocarbon column for hydrocarbon wells or similar wells generally comprises a tubing string and several casing strings. The tubing strings consists of a plurality of completion tubes accommodated inside the casing string. The casing string consists of a plurality of casing tubes arranged inside a drilling hole of the well. The casing tubes have a larger diameter cross-section than the diameter cross-section of the completion tubes and surround said completion tubes. In the lower part of the casing string, the casing tubes are also called liner tubes.

The casing strings are needed to maintain borehole stability, prevent contamination of water sands, and control well pressures during drilling, production, and/or workover operations.

The casing tubes and the completion tubes are made of steel and may be made, without limitation, according to API standards Specification 5CT or 5CRA for standard Casing and Tubing. For example, the steel is one of grade L80, P110 or Q125 standards.

Two tubes of a string may be attached by a threaded joint or connection. Typical threaded joint for connecting a first tube to a second tube may include a male threaded portion formed on the outer peripheral surface of the first tube, also called as a pin end, and a female threaded portion formed on the inner peripheral surface of the second tube, also called as a box end. The threaded portions cooperated so as to attach the first tube to the second tube, thus forming a threaded joint.

Another known type of threaded joint may include a coupling box for attaching a first tube and a second tube. Each first and second tube includes a pipe having, at both ends thereof, a male threaded portion formed on the outer peripheral surface, also called pin end. The first tube includes a coupling box having an inner hole provided with a female threaded portion formed on the inner periphery of the hole. The coupling box is generally previously connected to one end of the steel pipe by means of the male threaded portion of said end and the female threaded portion of the coupling box. By way of this arrangement, the first tube has a male threaded portion, also called a pin end, and a coupling box portion with a female threaded portion. The second tube may be attached to the first tube by means of the male threaded portion of said second tube and the female threaded portion of the coupling box.

Such threaded tubular connections are subjected to a variety of combination of stresses that may vary in intensity or change in direction, such as, for example, axial tension, axial compression, inner pressure bending force, torsional force, etc., Threaded tubular connections are thus generally designed to support those stresses, withstand rupture and provide tight sealing.

The solidity of a string of tubes thus generally relies on the absence of wear on the parts or portions forming the threaded connection or joint. It has therefore been proposed devices for protecting the threaded portions of tubes having a male threaded portion and a female threaded portion.

For operations on site, it is necessary to remove the protecting device prior to installing the tube in a well. It is preferable to remove the protecting device at the latest stages prior to installing the tube in the well. The protecting device then has to be unscrewed from the tube. These operations are particularly time consuming and demand a particular attention from operators who also have to manage tubes. The installation process of a column is thus rendered more complicated by the use of known protecting devices and weak points of a tube are not protected during installation of the column.

Furthermore, when mounting the male threaded portion of the second tube into the female threaded portion of the first tube, a stabbing guide is generally used. Such stabbing guide is positioned by an operator before inserting the male threaded end of the second tube into the female threaded end of the first tube and then removed before screwing the second tube in the first tube. Such operation also increases the operation time of installation of the column.

Additionally, known stabbing guides are installed on the female threaded end of a pipe on the drill floor, after said pipe has been lifted and put in position on the drill floor. The installation of such stabbing guides increases the exposure of operators on the drill floor which is a particularly dangerous area.

There is thus a need to reduce the installation time of a column, also called the "critical path activity", as well as the exposure of operators on the drill floor.

Indeed, said critical path activity is today around 200 seconds per tube, which leads to expensive installation operations, considering the high cost for a day rental of a rig.

BRIEF SUMMARY

The aim of the present invention is to overcome the aforementioned drawbacks.

It is a particular object of the present invention to provide a stabbing guide for allowing alignment of ends of tubes easier and quicker, while addressing a safety issue aimed at reducing the steps on the drilling site, notably on the drill floor.

Thus, the stabbing guide according to the invention is intended to be pre-installed on an area, called a "vee door", located outside the drill floor, before the tube is lifted in the air and being brought on the drill floor, called a "rotation table" for rotating the tubes in order to screw them together.

It is also an object of the invention to improve the protection of the coupling box portion of a tube intended to form a threaded joint during the installation process of the tube.

The invention provides a stabbing guide device for a steel tube designed to be secured on a portion of said tube used in a tubular column for oil and gas, energy, or storage applications, said device comprising:

- a substantially cylindrical body extending along a rotational axis designed to surround the portion of the first steel tube, said body forming an open ring so that a circumferential gap subsists between two free ends of said body; and a locking door secured in a non-detachable way to the body one of the two free ends of said cylindrical body and movable compared to said body between a locked position in which the locking surrounds the first tube, an intermediate position in which the locking door is able to slide along the rotational axis towards a lower end of the body and an unlocked position in which the locking door is able to rotate radially away from the body.

The locking door is thus movable relative to the body along two successive movements, a first translation movement of the locking door to slide said locking door along the rotational axis from the locked position to an intermediate position and a second rotational movement of the locking door to rotate said locking door away from the body from the intermediate position to the unlocked position.

The body and the locking door are configured to move one relatively to the other while being not separatable. The body and the locking door thus form one single piece design.

One of the body or the locking door comprises a hinge cooperating with at least one longitudinal shaft connected to the other of the locking door or the body the locking door being configured to rotate along the longitudinal shaft from the intermediate position to the unlocked position.

In an embodiment, one of the body or the locking door comprises a first longitudinal groove and the longitudinal shaft is slidably mounted in a said first longitudinal groove.

In an embodiment, one of the locking door or the cylindrical body further comprises at least one securing pad extending circumferentially away from said one of the locking door or the cylindrical body towards the other of the cylindrical body or the locking door, said securing pad being slidably mounted in a second longitudinal groove provided on one of the body or the other of the locking door when the locking door is in the intermediate position.

The stabbing guide device may be pre-installed on an area, called a "vee door", located outside the drill floor, before the tube is lifted in the air and being brought on the drill floor, called a "rotation table" for rotating the tubes in order to screw them together, thereby reducing the steps on the drilling site.

The hinge allows one of the body or the locking door to move, slide, or be lifted, toward the other of the locking door or the body. In closed position the hinge is locked, in open position the hinge is unlocked.

In an embodiment, the locking door comprises said at least one longitudinal shaft.

In another embodiment, the cylindrical body comprises said at least one longitudinal shaft.

Advantageously, each of the body and the locking door comprises a shoulder configured to bear axially on an end, i.e., the upper end of the portion of the first tube when secured to said tube.

The stabbing guide device is thus prevented from falling when secured on the first tube.

Furthermore, since the rotation of the locking door may occur only after said door has been slid downwardly towards the lower end of the body, when the stabbing guide device is mounted on the first tube, the rotation of the locking door is thus prevented thanks to the door self-blocked by the shoulder bearing on the upper end of the first tube.

In an embodiment, the locking door comprises an elongated body forming an angular segment fitted in the circumferential gap in the locked position and circumferentially delimited by two free ends or sides.

Advantageously, the longitudinal shaft is slidably mounted in said first longitudinal groove and connected to the other of the locking door or the body by at least one circumferential connecting pad extending circumferentially towards the one of the body or the locking door.

For example, the at least one longitudinal shaft is slidably mounted in a first longitudinal groove provided on the body, for example on one of the free ends, and connected to the locking door, for example to one of the sides of the elongated body, by at least one circumferential connecting pad extending circumferentially away from said locking door towards the body, for example one of its free ends. Said first groove is provided with a hinge for securing the shaft to the body.

For example, the longitudinal shaft is connected to the locking door, for example to the elongated body, by two connecting pads.

In another embodiment, the cylindrical body comprises at least one longitudinal shaft slidably mounted in a first longitudinal groove provided on the locking door and connected to the cylindrical body by at least one circumferential connecting pad extending circumferentially away from said cylindrical towards the locking door, said first groove being provided with a hinge for securing the shaft to the body.

In another embodiment, one of the free ends of the cylindrical body comprises at least one longitudinal shaft slidably mounted in a first longitudinal groove provided on one of the tangential sides of the body of the locking door and connected to one of the free ends of the body by at least one circumferential connecting pad extending circumferentially away from said free end towards one of the tangential sides of the body of the locking door, said first groove being provided with a hinge for securing the shaft to the body.

In other words, one of the locking door or the cylindrical body may comprises the longitudinal shaft and the first groove may be provided on the other of the cylindrical body or the locking door.

Advantageously, the length of the first longitudinal groove is greater than the length of the shaft so that said shaft may slide in said groove from the locked position to the intermediate position.

Advantageously, one of the locking door or the cylindrical body further comprises at least one securing pad connected to one of the tangential sides of the elongated body or the free ends of the circumferential body and extending circumferentially away from said one of said tangential side or said free ends towards the other of the free end of the body or the tangential side of the elongated body of the locking door.

For example, said securing pad is slidably mounted in a second longitudinal groove provided on one of the free ends of the body or the other of the tangential side of the elongated body of the locking door. Said second longitudinal groove is provided with at least one notch opening onto one of the free end of the body or the other of the tangential side of the elongated body of the locking door, and having a length greater than the length of the securing pad, so that said securing pad is configured to slide in said second groove from the locked position to the intermediate position and when the securing pad faces the notch, in the intermediate position, the locking door is configured to be rotated away from the body from the intermediate to the unlocked position.

In an embodiment, the locking door comprises said at least one securing pad connected to the other of the tangential sides of the elongated body and extending circumferentially away from said tangential side towards the other free end of the body.

For example, in an embodiment, said securing pad is slidably mounted in a second longitudinal groove provided on the other free end of the body and said second longitudinal groove is provided with at least one notch opening onto the other free end and having a length greater than the length of the securing pad, so that when the securing pad faces the notch, in the intermediate position, the locking door may be rotated away from the body from the intermediate to the unlocked position.

For example, the elongated body is provided with two securing pads each facing a notch of the second groove in the intermediate position.

In another embodiment, the cylindrical body comprises said at least one securing pad connected to the other of the free ends of the circumferential body and extending circumferentially away from said free end towards the other tangential side of the elongated body of the locking door.

For example, in said another embodiment, said securing pad being slidably mounted in a second longitudinal groove provided on the other tangential side of the elongated body of the locking door and said second longitudinal groove being provided with at least one notch opening onto said other tangential side and having a length greater than the length of the securing pad, so that when the securing pad faces the notch, in the intermediate position, the locking door may be rotated away from the body from the intermediate to the unlocked position.

The function of the securing pads is to prevent and lock the rotation of the locking door.

The elongated body of the locking door may be radially inwardly delimited by an inner cylindrical surface is provided with the shoulder and is further radially outwardly delimited by an outer cylindrical surface and circumferentially delimited by the two tangential sides.

For example, the elongated body of the locking door is further axially delimited by a lower end and an upper end, said upper end being connected to the shoulder by an inner tapered surface. The body is, for example, axially delimited by a lower end and an upper end, the upper end being connected to the shoulder by an inner tapered surface.

Said tapered surface has, for example, the same angle as the angle of the tapered surface of the elongated body of the locking door.

Said inner tapered surfaces act as a stabbing guide for the second completion tube. For example, each inner tapered surface forms an angle within a range 30° to 60°, for example 45°, with respect to the longitudinal axis of the outer circumferential surface of the body.

In an embodiment, the body and the elongated body of the locking door are each radially inwardly delimited by an inner cylindrical surface having the same diameter.

For example, the stabbing guide device may comprise a temporary protective closure covering the inner tapered surface of the body. Said protective closure aims at protecting the thread of the tubes during transport.

In an embodiment, said stabbing guide device may be made in plastic material using additive manufacturing with one step process, thereby reducing manufacturing costs. Alternatively, said stabbing guide device may be made in any other material.

According to another aspect, the invention concerns a steel tube intended for use in a tubular hydrocarbon column, preferably as a completion tube, said tube including a pin portion and a box portion configured to receive a pin portion of another second steel tube, and a device as described above secured to said first steel tube.

According to another aspect, the invention concerns a tubular hydrocarbon column comprising a first steel tube including a first pin portion and a first box portion, a second steel tube including a second pin portion configured to be screwed into the first box portion and a second box portion, and at least one stabbing guide device as described above mounted so as to be secured on the first box portion of the first tube, the first steel tube, the second steel tube and the stabbing guide are coaxial along the rotational axis when mounted.

For example, the stabbing guide device has a length smaller than the coupling length of the first tube with the second tube, but greater than the half of said coupling length. Such length of the stabbing guide device allows the device to be maintained in position even when vibrations occur.

BRIEF DESCRIPTION OF THE DRAWINGS

The present invention and its advantages will be better understood by studying the detailed description of a specific embodiment given by way of non-limiting examples and illustrated by the appended drawings on which.

DETAILED DESCRIPTION

In the following description, the terms "longitudinal, "transversal", "vertical", "front", "rear", "left" and "right" are defined according to a usual orthogonal benchmark as shown on the drawings, which includes:

- a longitudinal axis X, horizontal and left to the right of front views;
- a transversal axis Y, perpendicular to the longitudinal axis X and extending from the rear to the front of front views; and
- a rotation axis Z, vertical on the figures, orthogonal to the longitudinal and transversal axis X and Y.

Moreover, in the description and claims, the terms "outside" and "inside" and the orientations "axial" and "radial" shall be used to designate, according to the definitions given in the description, elements of the stabbing guide device or the tube. The vertical axis Z determines the "axial" orientation". The "radial" orientation is directed orthogonally to the vertical axis Z. the "circumferential" orientation is directed orthogonally to the axis Z of rotation and orthogonally to the radial direction, i.e., orthoradially. The terms "outside" and "inside" are used to define the orientation or the relative position of one component with respect to another, with reference to the axis of rotation Z. A component close or facing said axis Z is referred to as inside or inner as opposed to an outside or outer component located radially away from the vertical axis Z.

Figure 1:
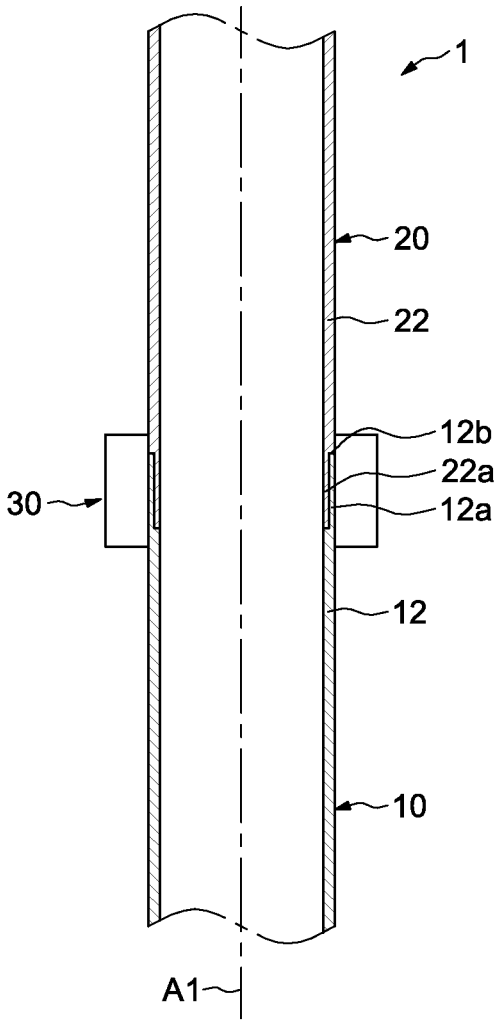
FIG. 1 is tubular hydrocarbon column having a stabbing guide device according to an embodiment of the invention.

FIG. 1 shows the general structure of a part of a tubular hydrocarbon column 1 having first tube 10, a second tube 20 mounted on said first tube 10 and a stabbing guide device 30 secured to the first tube 10.

The first tube 10 is substantially cylindrical and comprises a first lower end (not shown), also called a pin portion, having male threads (not shown) provided on the outer circumferential surface of said first lower end. The first tube 10 further comprises a second upper end 12, opposite to the first lower end, also called a box portion, having female threads 12*a* provided on the inner circumferential surface of said box portion.

The male threaded portion of the first lower end of the first tube 10 is designed to cooperate with a female threaded portion of a lower tube (not shown) and the female threaded portion 12 of said first tube 10 is designed to cooperate with male threads 22*a* of a male threaded portion 22 of an upper tube 20, i.e., the second tube.

The stabbing guide device 30 is mounted around the second upper end 12 of the first tube 10. As an alternative, the first tube may be a coupling box forming a sleeve having a substantially cylindrical shape and having inner female threads provided on its inner circumferential surface designed to cooperate with male threads of a lower tube (not shown) and with male threads of an upper following tube 20.

The first tube 10, the second tube 20 and the stabbing guide device 30 are coaxial along the rotational axis A1 when mounted.

The stabbing guide device 30 is shown in details on the FIGS. 2 to 6. Said stabbing guide device 30 extends along a rotational axis A1 parallel to the vertical axis Z as previously defined. The stabbing guide device 30 is thus designed to be mounted on the first tube 10, such as a completion tube, before operations on rigs and to guide the insertion of a second following tube 20 into the first tube 10.

The stabbing guide device 30 comprises a substantially cylindrical body 32 extending along the rotational axis A1 designed to surround the portion 12 of the first steel tube 10.

Figure 2:
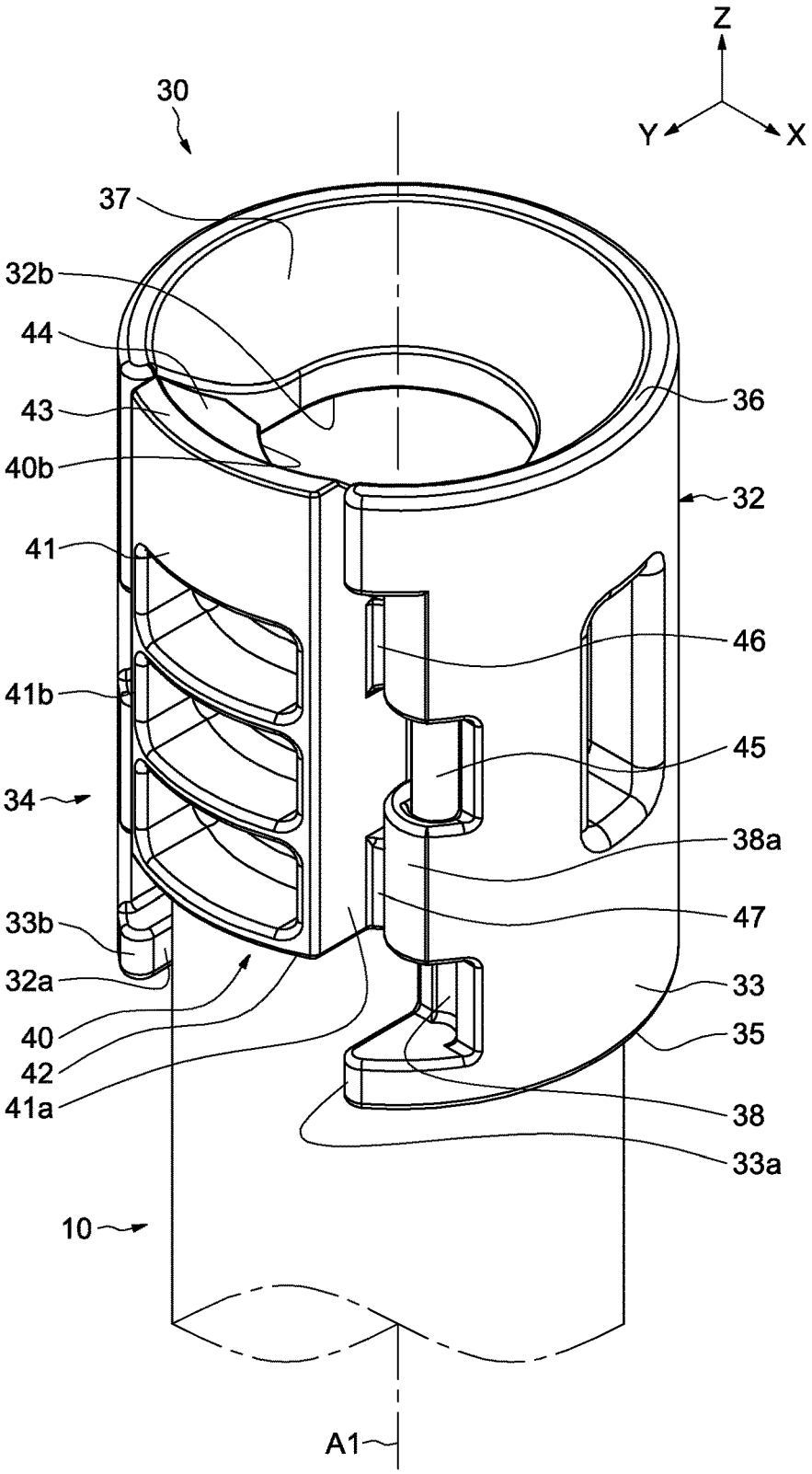
FIG. 2 is a perspective view of the stabbing guide device of FIG. 1, mounted on a first tube in a locked position.
Figure 6:
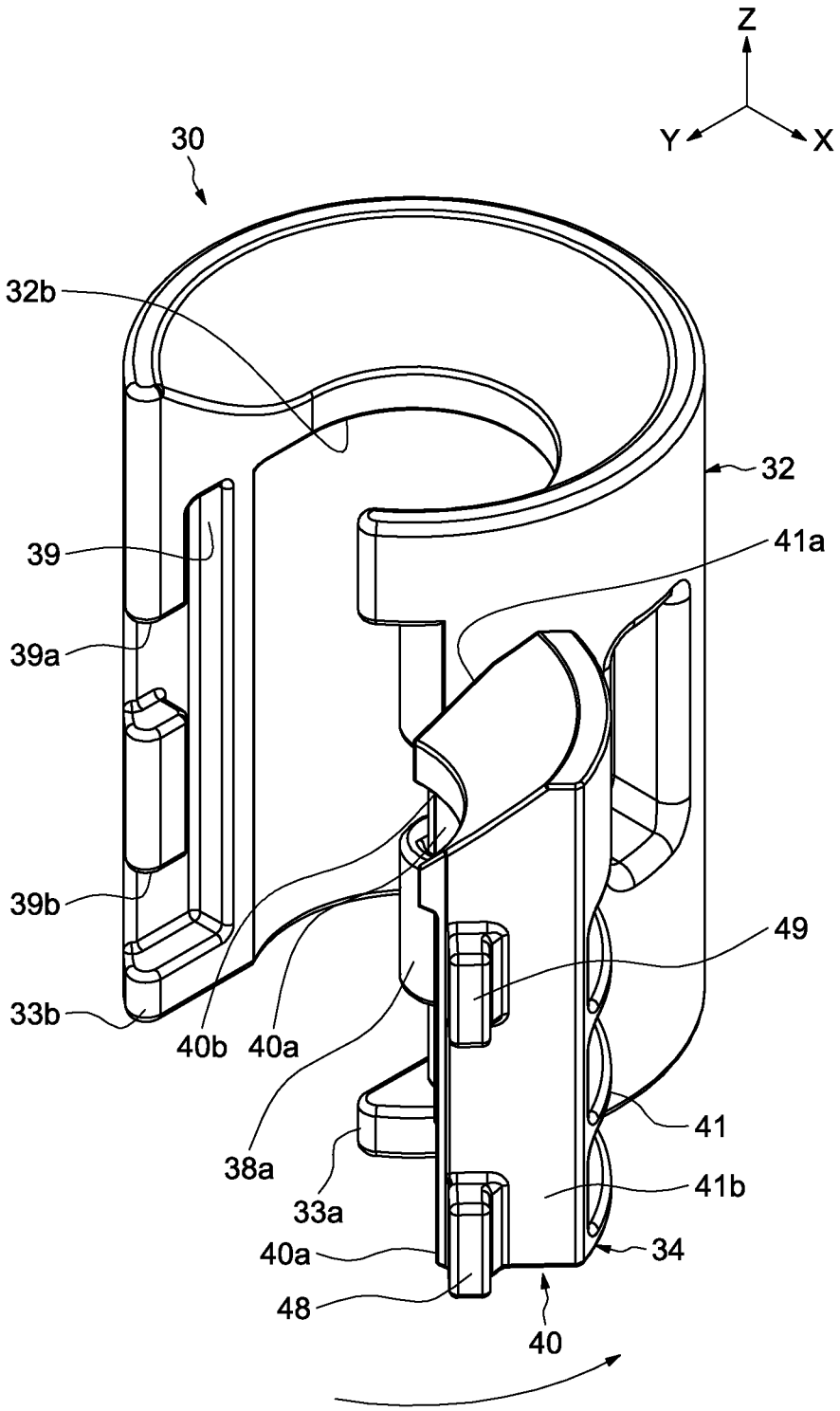
FIG. 6 is a perspective view of the device of FIG. 2 in an unlocked position.

The stabbing guide device 30 further comprises a locking door 34 secured in a non-detachable way to the body 32 and movable compared to said body 32 between a locked position, shown on FIG. 2, in which the locking door 34 rotates towards the body 32 and surrounds the first tube 10 and an unlocked position, shown on FIG. 6, in which the door 34 is rotated away from the body 32.

The body 32 and the locking door 34 are configured to move one relatively to the other while being not separatable. The body 32 and the locking door 34 thus form one single piece design.

As will be described further, the locking door 34 is movable relative to the body 32 along two successive movements, a first translation movement of the locking door 34 to slide said locking door 34 along the rotational axis A1 from the locked position to an intermediate position, shown on FIG. 5, and a second rotational movement of the locking door 34 to rotate said locking door away from the body 32 from the intermediate position to the unlocked position.

The body 32 is radially inwardly delimited by an inner cylindrical surface 32*a* having a first diameter ID1 substantially equal to the outer diameter of the first tube 10. The inner cylindrical surface 32*a* is provided with a shoulder 32*b* having a second diameter ID2 smaller than the first diameter ID1. The shoulder 32*b* is designed to bear against the free upper end 12*b* of the female threaded portion 12 of the first tube 10 when mounted on said first tube 10. The stabbing guide device 30 is thus prevented from falling when mounted on the first tube 10.

The body 32 is further radially outwardly delimited by an outer cylindrical surface 33 and circumferentially delimited by two tangential free ends 33*a*, 33*b*.

Figure 3:
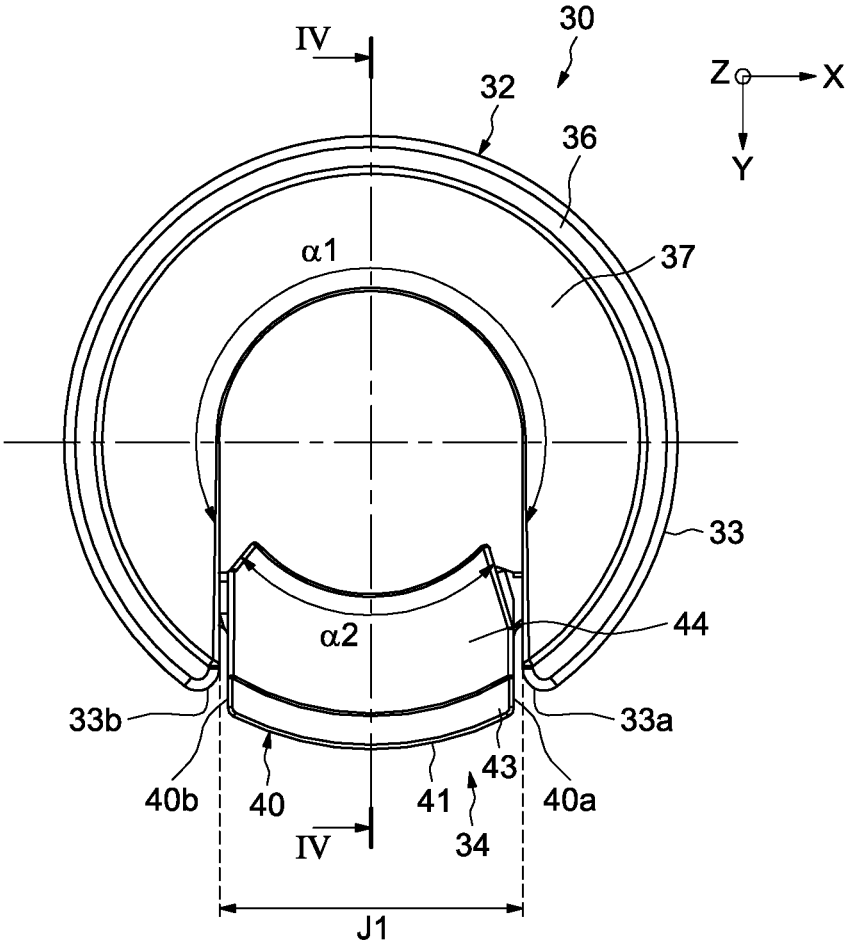
FIG. 3 is an upper view of the device of FIG. 2.
Figure 4:
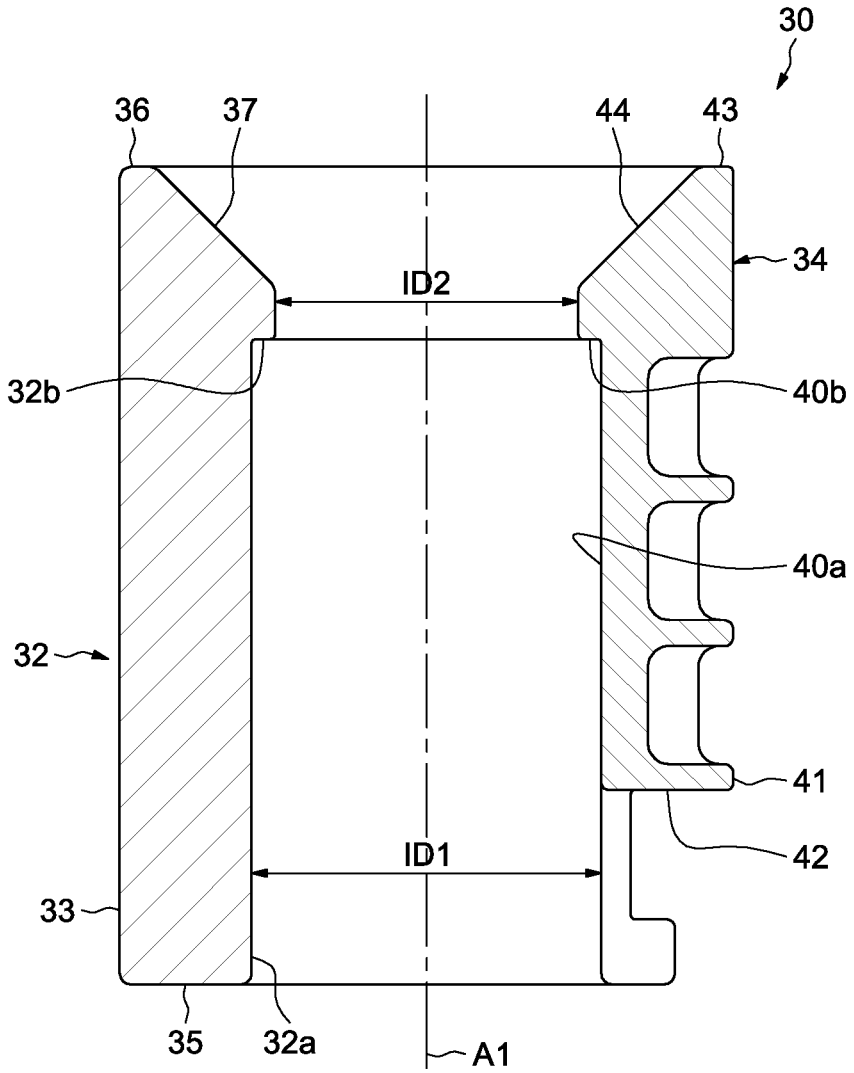
FIG. 4 is a cross-section view along line IV-IV of FIG. 3.

As can be seen of FIG. 3, the radial cross-section of the body 32 forms an arc of circle about an angle $\alpha 1$. The angle $\alpha 1$ is chosen in such a way that the tangential free ends 33*a*, 33*b* of the radial cross-section of the body 32 are circumferentially spaced by a circumferential gap J1. The angle $\alpha 1$ is more than 180°, preferable more than 200°, for example within a range of 200° to 350°, for example within 250° to 300°.

In other words, said body 32 forms an open ring so that the circumferential gap J1 subsists between two free ends 33*a*, 33*b* of said body 32.

The outer diameter OD of the cylindrical surface 33 of the body 32 is relatively small so as not to interfere with existing handling and lifting equipments.

The body 32 is designed to surround the box portion 12 of the first tube 10. However, the body 32 may be mounted on any portion of a tube.

The body 32 is further axially delimited by a lower end 35 and an upper end 36. The upper end 36 is connected to the shoulder 32*b* by an inner tapered surface 37. Said inner tapered surface 37 acts as a stabbing guide for the second completion tube 20. For example, the inner tapered surface 37 forms an angle within a range 30° to 60°, for example 45°, with respect to the longitudinal axis A1 of the outer circumferential surface 33 of said body 32.

As an alternative, the device 30 comprises a temporary protective closure (not shown) covering the inner tapered surface 37 of the body 32. Said protective closure aims at protecting the thread of the tubes during transport.

The body 32 has a length smaller than the coupling length of the first tube 10 with the second tube 20, but greater than the half of said coupling length. Such length of the stabbing guide device 30 allows the device to be maintained in position even when vibrations occur.

As illustrated, the locking door 34 is secured to the body 32 at the vicinity of the circumferential gap J1.

The locking door 34 comprises an elongated body 40 forming an angular segment fitted in the circumferential gap J1 in the locked position.

As can be seen of FIG. 3, the radial cross-section of the elongated body 40 of the locking door 34 forms an arc of circle about an angle $\alpha 2$. The angle $\alpha 2$ is chosen in such a way that, in the locked position, the radial cross-section of the device 30 is circular.

The elongated body 40 is radially inwardly delimited by an inner cylindrical surface 40*a* is provided with a shoulder 40*b*. The shoulder 40*b* is designed to bear against the free end, here the upper end, of the female threaded portion 12 of the first tube 10 when mounted on said first tube 10. The locking door 34 is thus prevented from moving from the locked position to the unlocked position when mounted on the first tube 10.

The elongated body 40 is further radially outwardly delimited by an outer cylindrical surface 41 and circumferentially delimited by two tangential free ends or sides 41*a*, 41*b*.

The elongated body 40 is further axially delimited by a lower end 42 and an upper end 43. The upper end 43 is connected to the shoulder 40*b* by an inner tapered surface 44. Said inner tapered surface 44 acts as a stabbing guide for the second completion tube 20. For example, the inner tapered surface 44 forms the same angle as the angle of the tapered surface 37 of the body 32.

The locking door 34 further comprises a longitudinal shaft 45 connected to one of the free ends 41*a* by to circumferential connecting pads 46, 47 extending circumferentially away from said free end towards one of the free ends 33*a* of the body 32. As an alternative, the longitudinal shaft 45 may be connected to one of the tangential free ends 41*a* by a single circumferential connecting pad.

The longitudinal shaft 45 is slidably mounted in a first longitudinal groove 38 provided on one of the free ends 33*a* of the body 32.

The length of the longitudinal groove 38 is greater than the length of the shaft 45 so that said shaft may slide in said groove 38 from the locked position to the intermediate position and the groove 38 is provided with a hinge 38*a* for securing the shaft 45 to the body 32.

The locking door 34 further comprises two securing pads 48, 49 connected to the other of the free ends 41*b* and extending circumferentially away from said free end towards the other free end 33*b* of the body 32. As an alternative, the locking door 34 may comprise single securing pad.

Each securing pads 48, 49 is slidably mounted in a second longitudinal groove 39 provided on the other free end 33*b* of the body 32.

The invention is not limited to such configuration and it is possible to provide the shaft 45 on the cylindrical body 32 and the first longitudinal groove 38 on the locking door 34.

It is also possible to provide the securing pads 48, 49 on the cylindrical body 32 and the second longitudinal groove 39 on one of the tangential free ends 41*a*, 41*b* of the locking door 34.

The length of the second longitudinal groove 39 is greater than the length of the securing pads 48, 49 so that said securing pads 48, 49 may slide in said groove 39 from the locked position to the intermediate position.

The groove 39 is provided with two notches 39*a*, 39*b* opening onto the free end 33*b* and having a length greater than the length of the securing pads 48, 49, so that when the securing pads 48, 49 are each facing one of the notches 39*a*, 39*b*, in the intermediate position, the locking door 34 may be rotated away from the body 32 from the intermediate to the unlocked position.

Figure 5:
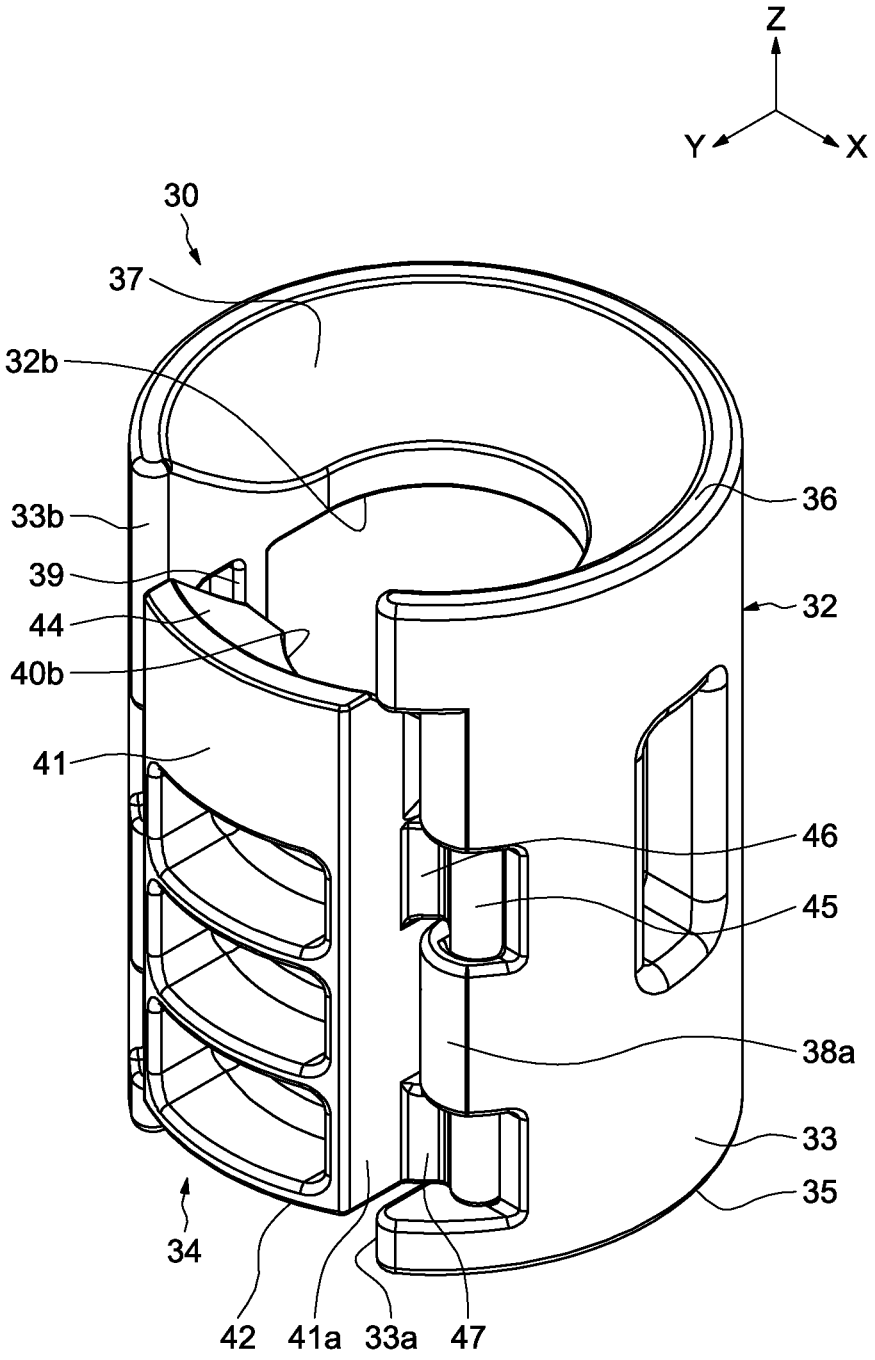
FIG. 5 is a perspective view of the device of FIG. 2 in an intermediate position.

The stabbing guide device 30 thus comprises a locking door 34 mounted movable on the body 32 between a locked position, shown on FIGS. 1 to 4 and 7, in which the locking door 34 rotates towards the body 32 and surrounds the first tube 10, an intermediate position, shown on FIG. 5, in which the locking door 34 is slid downwardly to the lower end 35 of the body 32 so that the securing pads 48, 49 of the door 34 faces the notches 39*a*, 39*b* of the body, and an unlocked position, shown on FIG. 6, in which said locking door 34 is rotated radially away from the body 32. The locking door 34 is configured to reduce the circumferential gap J1 of the body 32 in the locked position.

The rotation of the locking door 34 may occur only after said door has been slid downwardly towards the lower end 35 of the body 32. When the stabbing guide device 30 is mounted on the first tube 10, the rotation of the locking door 34 is thus prevented thanks to the door self-blocked by the shoulder 40*b* bearing on the upper end 12*b* of the first tube 10. The gravity thus prevents the locking door 34 to be slid downwardly towards the lower end 35 of the body 32.

The stabbing guide device 30 may be made in plastic material using additive manufacturing with one step process, thereby reducing manufacturing costs.

The stabbing guide device 30 may further include a radio frequency identification chip (RFID chip) (not shown), for example located in a groove on the outer surface of the body 32. The chip may include data such as the dimensions of the tube and/or the threaded portions. By virtue of the chip, it is not necessary to remove the device from the tube in order to determine such data.

The stabbing guide device 30 may also include sensors (not shown), such as pressure sensors, temperatures sensors in order to monitor the pressure exerted on the box portion 12 of the tube 10 and/or of the drilling fluid or cement, as well as the temperature of said box portion and/or of the drilling fluid or cement.

Figure 7:
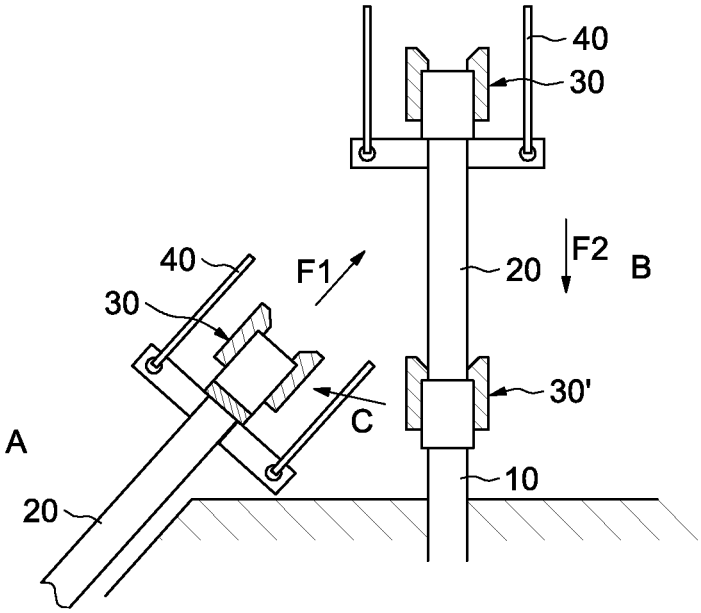
FIG. 7 illustrates installation steps of a tube having the device of FIG. 2.

As shown on FIG. 7, the completion tube 10 is equipped with the stabbing guide device 30' immediately after its manufacture, before lifted for installation on a rig according to arrow F1 with a lifting device 40.

After installation of the first completion tube 10 on the rig floor, a following completion tube 20 equipped with the device 30 is lifted, at step A.

The gravity prevents the locking door 34 to be slid downwardly towards the lower end 35 of the body 32 and thus to rotate to the unlocked position.

At step B, the following completion tube 20 is installed on the rig floor according to arrow F2, and its lower portion is guided by the device 30, so that the male threaded portion 22 of said following completion tube 20 is inserted in the box portion 12 of the first tube 10.

Once the following completion tube 20 is stabbed on the first tube 10, the stabbing guide device 30' may be removed by lifting upwardly, thereby allowing the locking door 34 to slide downwardly towards the lower end 35 of the body 32, and thus allowing the rotating of said locking door 34 in the unlocked position. The stabbing guide device 30' may thus be mounted on another following completion tube.

There may thus be one, two or more than two stabbing guides devices 30 used at the same time on the rig floor.

The stabbing guide device 30, 30' thus acts as a stabbing guide for a following completion tube, without the need of additional tools. The first and second tubes are metal tubes intended for use in a tubular hydrocarbon column.

The stabbing guide device 30, 30' may fully protect the box portion 12 of the tube 10 during transport and storage of said tube and may therefore be considered as a protective device.

The stabbing guide device is pre-installed on an area, called a "vee door", located outside the drill floor, before the tube is lifted in the air and being brought on the drill floor, called a "rotation table" for rotating the tubes in order to screw them together, thereby reducing the steps on the drilling site.

The device 30 according to the invention is a multipurpose tool configured to protect the box portion of a tube and to guide the insertion of the male threaded portion of a second tube into the female threaded portion of a first tube. Said device has thus two functions.

Furthermore, thanks to the device according to the invention, no tool is needed to fix it on the corresponding tube such that the critical path activity or installation time of a tube is significantly reduced, for example around 3 seconds to 5 seconds, which leads to a considerable cost reduction of the installation operations. The device thus facilitates installation process of tubes in a casing string or in a drill hole.

The invention claimed is:

1. A stabbing guide device for a steel tube configured to be secured on a portion of said tube used in a tubular column for oil and gas, energy, or storage applications, said device comprising:

a substantially cylindrical body extending along a rotational axis configured to surround the portion of the first steel tube, said body forming an open ring so that a circumferential gap subsists between two free ends of said body; and a locking door secured in a non-detachable way to the body at one of the two free ends of said body, one of the body or the locking door comprising a hinge cooperating with at least one longitudinal shaft connected to an other of the locking door or the body, the locking door being configured to move compared to said body between:

a locked position in which the locking door surrounds the first tube and is blocked in rotation around the longitudinal shaft, the locking door being, in said locked position, able to slide along the rotational axis towards a lower end of the body into an intermediate position, the intermediate position in which the locking door surrounds the first tube and is able to rotate radially away from the body, and an unlocked position in which the locking door is radially away from the body, the locking door being configured to rotate along the longitudinal shaft from the intermediate position to the unlocked position.

2. The stabbing guide device according to claim 1, wherein one of the body or the locking door comprises a first longitudinal groove and wherein the longitudinal shaft is slidably mounted in said longitudinal groove.

3. The stabbing guide device according to claim 2, wherein a length of the first longitudinal groove is greater than a length of the shaft so that said shaft is configured to slide in said groove from the locked position to the intermediate position.

4. The stabbing guide device according to claim 2, wherein one of the locking door or the cylindrical body further comprises at least one securing pad extending circumferentially away from said one of the locking door or the cylindrical body towards the other of the cylindrical body or the locking door, said securing pad being slidably mounted in a second longitudinal groove provided on one of the body or the other of the locking door when the locking door is in the intermediate position, wherein the locking door comprises an elongated body forming an angular segment fitted in the circumferential gap in the locked position and circumferentially delimited by two tangential sides, and wherein the securing pad is connected to one of the tangential sides of the elongated body or the free ends of the circumferential body and extending circumferentially away from said one of said tangential side or said free ends towards the other of the free end of the body or the tangential side of the elongated body of the locking door.

5. The stabbing guide device according to claim 4, wherein said securing pad being slidably mounted in a second longitudinal groove provided on one of the free end of the body or the other of the tangential side of the elongated body of the locking door, said second longitudinal groove being provided with at least one notch opening onto one of the free end of the body or the other of the tangential side of the elongated body of the locking door, and having a length greater than the length of the securing pad, so that said securing pad is configured to slide in said second groove from the locked position to the intermediate position and when the securing pad faces the notch, in the intermediate position, the locking door is configured to be rotated away from the body from the intermediate to the unlocked position.

6. The stabbing guide device according to claim 1, wherein one of the locking door or the cylindrical body further comprises at least one securing pad extending circumferentially away from said one of the locking door or the cylindrical body towards the other of the cylindrical body or the locking door, said securing pad being slidably mounted in a second longitudinal groove provided on one of the body or the other of the locking door when the locking door is in the intermediate position.

7. The stabbing guide device according to claim 1, wherein each of the body and the locking door comprises a shoulder configured to bear axially on an upper end of the portion of the first tube when secured to said tube.

8. The stabbing guide device according to claim 1, wherein the locking door comprises an elongated body forming an angular segment fitted in the circumferential gap in the locked position and circumferentially delimited by two tangential sides.

9. The stabbing guide device according to claim 1, wherein the longitudinal shaft is connected to the other of the locking door or the body by at least one circumferential connecting pad extending circumferentially towards the one of the body or the locking door.

10. The stabbing guide device according to claim 9, wherein each of the body and the locking door comprises a shoulder configured to bear axially on an upper end of the portion of the first tube when secured to said tube, wherein the locking door comprises an elongated body forming an angular segment fitted in the circumferential gap in the locked position and circumferentially delimited by two tangential sides, wherein the elongated body of the locking door is further axially delimited by a lower end and an upper end, said upper end being connected to the shoulder by an inner tapered surface, and wherein the body is axially delimited by a lower end and an upper end, the upper end being connected to the shoulder by an inner tapered surface.

11. The stabbing guide device according to claim 1, wherein each of the body and the locking door comprises a shoulder configured to bear axially on an upper end of the portion of the first tube when secured to said tube, wherein the locking door comprises an elongated body forming an angular segment fitted in the circumferential gap in the locked position and circumferentially delimited by two tangential sides, wherein the elongated body of the locking door is radially inwardly delimited by an inner cylindrical surface is provided with the shoulder and is further radially outwardly delimited by an outer cylindrical surface and circumferentially delimited by the two tangential sides.

12. The stabbing guide device according to claim 1, wherein the locking door comprises an elongated body forming an angular segment fitted in the circumferential gap in the locked position and circumferentially delimited by two tangential sides, and wherein the body and the elongated body of the locking door are each radially inwardly delimited by an inner cylindrical surface having the same diameter.

13. A steel tube for use in a tubular hydrocarbon column, said tube comprising:

a pin portion and a box portion configured to receive a pin portion of another second steel tube, and the stabbing guide device according to claim 1 secured to said first steel tube.

14. The steel tube according to claim 13, wherein the steel tube is a completion tube.

15. A tubular hydrocarbon column comprising:

a first steel tube including a first pin portion and a first box portion, a second steel tube including a second pin portion configured to be screwed into the first box portion of the first steel tube and a second box portion, and the stabbing guide device according to claim 1 mounted so as to be secured on the first box portion of the first steel tube, wherein the first steel tube, the second steel tube, and the stabbing guide are coaxial along the rotational axis when mounted.

* * * * *